United States Patent [19]

Dubinsky

[11] 4,375,222

[45] Mar. 1, 1983

[54] UMBRELLA COVER

[76] Inventor: Emanuel Dubinsky, 99 Kingston Ave., Yonkers, N.Y. 10704

[21] Appl. No.: 220,119

[22] Filed: Dec. 24, 1980

[51] Int. Cl.[3] ..... A45B 25/18

[52] U.S. Cl. ..... 135/33 C; 47/21

[58] Field of Search ..... 135/33 R, 33 C, 34, 135/36 F; 47/20, 21, 22, 28 R, 28.1, 29; 150/DIG. 1

[56] References Cited

U.S. PATENT DOCUMENTS

| | | | |
|---|---|---|---|
| 995,657 | 6/1911 | Bolt | 47/28 |
| 1,233,099 | 7/1917 | Miller | 47/21 |
| 1,820,040 | 8/1931 | Zuckerman | 47/22 |
| 1,834,084 | 12/1931 | Barnes | 47/21 |
| 3,431,926 | 3/1969 | Dubinsky | 135/34 |
| 3,490,469 | 1/1970 | Dubinsky | 135/33 C |
| 4,062,370 | 12/1977 | Brickner | 135/33 C |

*Primary Examiner*—Harland S. Skogquist
*Attorney, Agent, or Firm*—Hubbell, Cohn, Stiefel & Gross

[57] ABSTRACT

An umbrella cover (10) is provided in which a sleeve (10) contains a substantially rigid telescoping support rod (20) which enables the cover (10) to be readily mounted on an umbrella canopy (12) while facilitating compact storage of the cover (10). The lower end of the sleeve (10) includes a flap portion (16) which is folded back to form a cuff (24) prior to lifting the cover (10) over the umbrella (12). A stiffening strip (30) is provided along the lower edge of the cuff (24) to facilitate placement of the cover (10) over the umbrella (12). The flap portion (16) is temporarily held in the cuff configuration (24), which is preferably tricorner, by Velcro fasteners (26) which facilitate the fastening and unfastening of the flap portion (16).

12 Claims, 5 Drawing Figures

UMBRELLA COVER

TECHNICAL FIELD

The present invention relates to protective umbrella covers, and particularly to such covers which may be easily mounted and dismounted from the canopy of an umbrella, while being compactly storable when not in use.

BACKGROUND ART

Umbrella covers are well known in the art such as disclosed in my earlier U.S. Pat. No. 3,490,469, and in U.S. Pat. No. 4,062,370. With respect to my earlier U.S. Pat. No. 3,490,469, although the umbrella cover described therein is satisfactory for most purposes, it contains certain features which are not as desirable from a manufacturing and storage standpoint. Namely, this cover utilizes a zipper closure for a slit extending substantially the entire length of the cover as well as having an assembled rod which also extends for substantially the entire length of the cover. While these features help facilitate usage of the cover, they can be disadvantageous from a manufacturing and storage standpoint in that the long rod may make storage or packaging of the cover cumbersome, and the zipper may rust if made of metal or may experience difficulty in opening if made of plastic.

As discussed in U.S. Pat. No. 4,062,370, in an effort to overcome some of those disadvantages, an umbrella cover may be provided which does not have have a zipper closure in that it forms an envelope, similar to that disclosed in U.S. Pat. No. 1,820,040 for use on trees. However, such a cover does not have an installed rigid support but rather relies on the use of a pole whose tip is slipped into a pocket to lift the cover on and off the umbrella. This arrangement is unsatisfactory and is less advantageous in use than the prior art arrangement of U.S. Pat. No. 3,490,469. Thus in attempting to solve some of the potential manufacturing and storage difficulties of the arrangement disclosed in U.S. Pat. No. 3,490,469, the arrangement disclosed in U.S. Pat. No. 4,062,370 reintroduces the usage disadvantages previously overcome by the arrangement disclosed in U.S. Pat. No. 3,490,469. Thus, applicant is not presently aware of any satisfactory prior art arrangement which is advantageous not only in usage but in manufacturing and storage as well.

These disadvantages of the prior art are overcome by the present invention.

DISCLOSURE OF THE INVENTION

A protective umbrella cover is provided in which a sleeve of substantially pliable material contains a substantially rigid telescoping support rod partially extending along the length of the sleeve, whereby the cover may be readily mounted upon an umbrella canopy with the support rod telescopically extended and coverage of the canopy completed by telescopic closure of the rod. The lower end of the sleeve, which is open, comprises a flap portion which is folded up to form a cuff such as a tricorner configuration, and temporarily held in position, such as by Velcro fasteners. The bottom portion of the sleeve also includes an inner circumferential stiffening member, such as plastic or vinyl webbing to facilitate mounting of the sleeve on the umbrella canopy by keeping the bottom open. The telescoping rod is secured with the sleeve for a distance which is preferably less than half the length of the sleeve which facilitates storage and packaging of the cover. In use, the cuff is held in position prior to lifting of the cover over the canopy, the telescoping rod is extended and the cover lifted over the canopy by the rod. As the cover is brought down over the canopy, the rod retracts until the cover is fully in position. Thereafter, the flap is pulled down and may be tied in position by a drawstring.

BEST MODE FOR CARRYING OUT THE INVENTION

Figure 1:
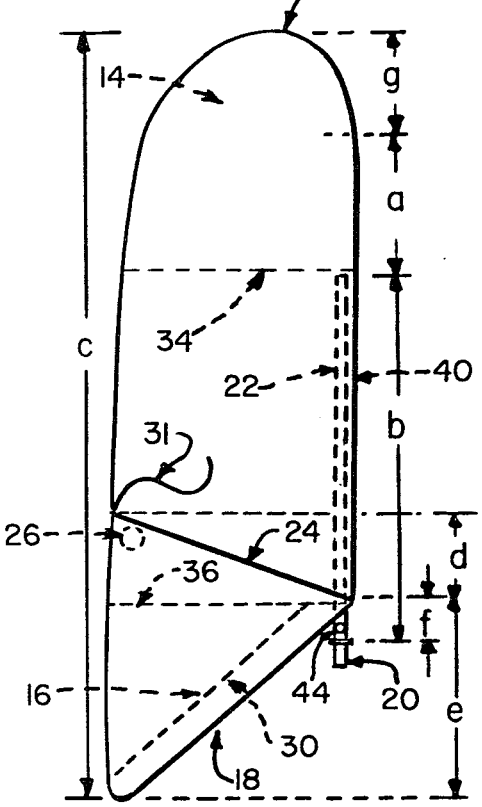
FIG. 1 is side elevational view of an umbrella cover in accordance with the present invention.

Referring now to the drawings in detail and initially to FIG. 1 thereof, a protective umbrella cover, generally referred to by the reference numeral 10, in accordance with the present invention is shown. The umbrella cover as will be explained in greater detail hereinafter, is preferably arranged to be lifted over a conventional umbrella canopy 12 such as a garden or bench umbrella, and pulled down to form a protective covering for the umbrella 12. In addition, as will also be explained in greater detail hereinafter the cover 10, which is preferably formed of a soft pliable material, such as vinyl or weather protected fabric, is constructed so as to be compactly storable and/or packaged.

Figure 5:
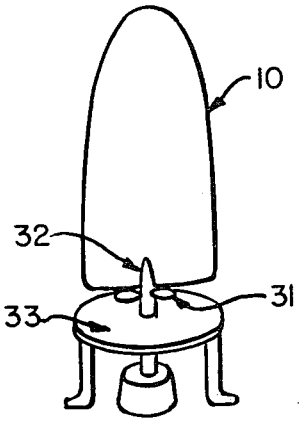
FIG. 5 is a diagrammatic illustration, similar to FIG. 4, showing a front view of the cover in position with the covering procedure completed.

As shown and preferred in FIG. 1, the cover 10 may generally be of a tapered configuration having a peak portion 14 at the upper end and a flap portion 16 at the bottom end. The cover 10 forms a sleeve, with the cover 10 being mountable over the umbrella canopy 12 through the opening 18 at the bottom of the sleeve 10. Preferably a telescoping rigid support rod 20 is secured in the sleeve 10 such as by being sewn in a pocket 22 formed along one side of the sleeve 10. The flap portion 16, as will be described in greater detail hereinafter, is preferably foldable up to form a tricorner configured cuff 24 which is temporarily securable in this configuration to the outside of the sleeve 10 by means of Velcro fasteners 26 or some other type of temporary attachment means. An inner circumferential stiffening member of reinforcing strip or band 30, such as one formed from a plastic or vinyl webbing of the type used for tubular furniture, such as a 12 gauge, two inch wide webbing strip, is preferably located within the interior of the sleeve 10 along the fold line for the flap portion 16 so as to reinforce the bottom opening 18 of the sleeve 10 when the flap portion 16 forms the cuff 24 and, thereby, keep the bottom of the cover 10 open and facilitate placement of the cover 10 over the canopy 12. The flap portion 16 preferably includes a conventional drawstring 31 at the bottom to enable the mounted cover 10 to be tied closed. The triangular configured cuff 24 formed by portion 16 necessitates provision of a longitudinal slit 32 (FIG. 5) having a longitudinal extent e equal to the height of the triangular space formed when the cuff 24 is formed.

Figure 2:
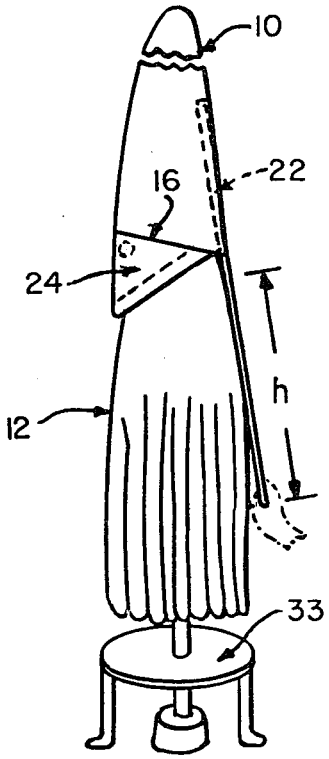
FIG. 2 is a diagrammatic illustration showing the manner in which the cover of FIG. 1 is lifted over an umbrella canopy.
Figure 3:
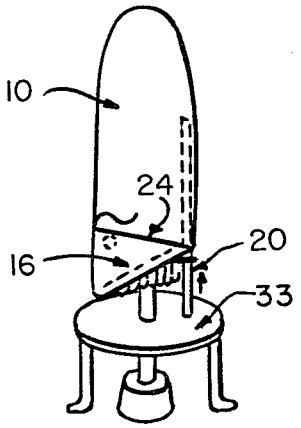
FIG. 3 is a diagrammatic illustration, similar to FIG. 2, illustrating the cover of FIG. 1 in position over the umbrella canopy prior to completion of the covering procedure.

As will be described hereinafter the telescoping supporting rod 20 enables the secured rod 20 to be extended to its full length to facilitate lifting of the cover 10 over the canopy 12 while enabling the rod 20 to be retracted as the cover 10 is being brought down over the umbrella 12 and the rod 20 contacts a table top 33, as illustrated in FIG. 3. In addition, the telescoped rod 20 enables this removed cover 10 to be folded along fold lines 34 and 36 to form a compact storage assembly. By way of example, as shown in FIGS. 1 and 2, for conventional garden type umbrellas, the approximate relative dimensions of the cover 10, using the reference letters a,b,c,d,e,f,g and h, are as follows: a=22 inches, b=30 inches, c=70 inches, d=e=15 inches, f=1 inch, g=4 inches and h=30 inches with approximately an additional 2 inch overlap of the two portions of the telescoping rod 2D. The telescoping rod 20 preferably has the two portions secured to each other by a conventional umbrella type spring lock 44 which when pushed in will enable the rod 20 to be extended to its full height or will enable the rod 20 to be retracted as a result of upward pressure against the bottom portion of the rod 20.

Figure 4:
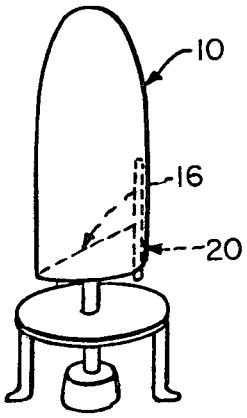
FIG. 4 is a diagrammatic illustration, similar to FIG. 3, with the covering procedure completed.

Referring now to FIGS. 2–5, the cover 10 is preferably used as follows. The flap portion 16 is folded up to form the triangular cuff 24, if not already in this position, and temporarily secured in place by fasteners 26, with one cuff 24 being formed on each of the two sides of the cover 10. The spring lock 44 on the rod 20 is then pushed in and the rod 20 is then extended to its full length, as shown in FIG. 2, and the cover 10 is lifted over the umbrella canopy 12. Once the cover 10 is over the umbrella 12, the sewn in portion 40 of the rod 20 and the reinforced bottom portion 30 of the cover 10 enables the cover 10 to readily fall into place about halfway down on the umbrella 12. As the user continues to pull the cover 10 down over the umbrella 12, the bottom of the rod 20 contacts the table top 33 (FIG. 3) and, the user again pushes in the spring lock 44 releasing 14. The continued pressure of the rod 20 against the table top 33 as the cover 10 is thereafter pulled downward by the user will cause the rod 20 to telescope back and retract until the cover 10 is completely in position. If the rod 20 did not retract, it could interfere with the cover 10 being fully placed in position because of the table top 33. Thereafter, the rod 20 may be locked in the retracted position due to a second conventional detent on the bottom portion of the rod 20. The flap portions 16 are then separated from the fasteners 26 on the sleeve 10 and the flaps 16 are then folded down (FIG. 4). If desired, the drawstring 31 may be pulled tight and tied to complete the installation of the cover 10 on the umbrella 12. To remove and store the cover, the above procedure is reversed. When the cover 10 is removed and the rod 20 has been retracted, the cover 10 may be refolded along fold lines 34 and 36 and stored in a compact package whose overall height would be the height b of the upper portion of the telescoping rod 20.

Thus, by utilizing the present invention a compactly storable umbrella cover may be provided without sacrificing the advantages provided by rigid rod support.

It is to be understood that the above described embodiment of the invention is merely illustrative of the principles thereof and that numerous modifications and embodiments of the invention may be denied within the spirit and scope thereof.

What is claimed is:

1. An umbrella cover comprising a sleeve of substantially pliable material having an upper end and a lower end, said lower end being open for receiving the canopy of an umbrella into said sleeve, said open lower end comprising a flap portion having an upper edge and a lower edge, said flap portion lower edge defining the bottom of said sleeve; an inner circumferential stiffening member within said sleeve interior, said stiffening member being disposed adjacent said flap portion upper edge and extending about the longitudinal axis of said sleeve; and a substantially rigid telescoping support rod member retainable within said sleeve and partially extending along said sleeve in the direction of said sleeve longitudinal axis; whereby said cover may be readily mounted upon said umbrella canopy with said support rod telescopically extended and coverage of said canopy completed by telescopic closure of said support rod.

2. An umbrella cover in accordance with claim 1 whereby said sleeve comprises first temporary attachment means on the exterior thereof and said flap portion comprises second temporary attachment means on the exterior thereof, said first and second temporary attachment means cooperating with each other to temporarily secure said flap portion in a folded position for defining a cuff, said stiffening member being adjacent the bottom of the opening defined by said cuff, whereby lifting of said cover over said canopy is facilitated.

3. An umbrella cover in accordance with claim 2 wherein said rod support member is secured within a pocket in said sleeve.

4. An umbrella cover in accordance with claim 3 wherein said first and second temporary attachment means comprise Velcro strips.

5. An umbrella cover in accordance with claim 4 wherein said stiffening member comprises a plastic webbing strip.

6. An umbrella cover in accordance with claim 2 wherein said sleeve is closed at said upper end.

7. An umbrella cover in accordance with claim 2 wherein said first and second temporary attachment means comprise Velcro strips.

8. An umbrella cover in accordance with claim 1 wherein said rod support member is secured within a pocket in said sleeve.

9. An umbrella cover in accordance with claim 1 wherein said stiffening member comprises a plastic webbing strip.

10. An umbrella cover in accordance with claim 1 wherein said sleeve is closed at said upper end.

11. An umbrella cover in accordance with claim 8 wherein said secured rod support member has a secured portion longitudinally only partially extending for less than half the height of said sleeve for facilitating storage of said cover.

12. An umbrella cover in accordance with claim 2 wherein said cuff comprises a tricorner configuration, whereby mounting of said cover over said canopy is facilitated.

* * * * *